US008757459B2

(12) United States Patent
Crawford et al.

(10) Patent No.: US 8,757,459 B2
(45) Date of Patent: Jun. 24, 2014

(54) BOAT ACCESSORY PLATFORM

(76) Inventors: Steven Mark Crawford, Renick, WV (US); Donald Vinton Blake, Sr., Frankford, WV (US)

( * ) Notice: Subject to any disclaimer, the term of this patent is extended or adjusted under 35 U.S.C. 154(b) by 301 days.

(21) Appl. No.: 13/385,547

(22) Filed: Feb. 25, 2012

(65) Prior Publication Data

US 2012/0280012 A1 Nov. 8, 2012

Related U.S. Application Data

(60) Provisional application No. 61/482,912, filed on May 5, 2011.

(51) Int. Cl.
*B63B 25/00* (2006.01)

(52) U.S. Cl.
CPC ..... *B63B 25/00* (2013.01); *Y10S 224/922* (2013.01)
USPC ..... 224/406; 224/922; 114/364

(58) Field of Classification Search
CPC ..... B63B 25/00
USPC ..... 224/406, 922; 114/364, 218
See application file for complete search history.

(56) References Cited

U.S. PATENT DOCUMENTS

| | | | | | |
|---|---|---|---|---|---|
| 3,844,519 | A * | 10/1974 | Garrett | 248/226.11 |
| 3,927,487 | A | 12/1975 | Miyamae | |
| 4,081,165 | A * | 3/1978 | Fentress | 248/205.1 |
| 4,159,816 | A | 7/1979 | Miyamae | |
| 4,709,890 | A * | 12/1987 | Moore | 248/205.1 |
| 5,163,652 | A | 11/1992 | King | |
| 5,312,077 | A * | 5/1994 | Gutierrez | 248/214 |
| 5,519,959 | A * | 5/1996 | Cross | 43/21.2 |
| 5,564,670 | A * | 10/1996 | Dysarz | 248/515 |
| 5,662,306 | A * | 9/1997 | Dysarz | 248/514 |
| 6,155,191 | A * | 12/2000 | Weaver | 114/218 |
| 6,568,648 | B1 * | 5/2003 | Ray | 248/538 |
| 6,983,525 | B2 | 1/2006 | Moreno | |
| 7,520,233 | B1 | 4/2009 | Lyon | |
| 7,555,993 | B2 * | 7/2009 | Quinn et al. | 114/230.11 |
| 7,603,960 | B1 * | 10/2009 | Perry et al. | 114/364 |
| 7,946,239 | B1 * | 5/2011 | Perry et al. | 114/218 |
| 8,286,572 | B1 * | 10/2012 | Picek et al. | 114/343 |
| 2003/0230024 | A1 * | 12/2003 | Roberson | 43/21.2 |
| 2008/0105800 | A1 * | 5/2008 | Menning et al. | 248/200 |
| 2012/0017818 | A1 * | 1/2012 | Arote | 114/218 |

* cited by examiner

*Primary Examiner* — Justin Larson
(74) *Attorney, Agent, or Firm* — W. Allen Marcontell

(57) ABSTRACT

An accessory platform for fishing rods, light bars, flag masts and similar accessories often used on small boats and watercraft is secured to a mooring cleat by means of an underslung clamping bar having a transversely positioned anchor finger or fork. The anchor finger is positioned to penetrate the arch between cleat legs. The clamping bar is then raised against the cleat arch bight by rotation of a suspension screw.

15 Claims, 4 Drawing Sheets

BOAT ACCESSORY PLATFORM

CROSS-REFERENCE TO RELATED APPLICATION

The present application claims the Priority Date Benefit of Provisional Application No. 61/482,912 filed May 5, 2011.

BACKGROUND OF THE INVENTION

1. Field of the Invention

This invention relates to a portable or removable accessory platform that is conveniently secured to permanently attached deck hardware such as a mooring cleat on a boat, barge or other type of buoyant vessel.

2. Description of Related Art

The owners and operators of pleasure craft and relatively small fishing boats often need or desire a convenient means to secure an accessory article or device such as a fishing rod, flag mast or special lighting for example, to a hull, gunwale or deck portion of their vessel.

Often, such vessels are highly finished with polished fiberglass, brightly painted or varnished surfaces. Understandably, the owner of such a craft is reticent to disturb his expensive and artistic finish for the purpose of temporarily securing an occasionally used accessory. Responsively, the prior art has turned to the deck mooring cleats that are permanently and securely attached to the decks or gunwales of most vessels as a convenient temporary anchor point for an accessory platform.

As boat designs, materials and construction methods have evolved, a trend has developed for removing all obstructions and discontinuities from the deck surfaces. While most boat owners still consider mooring cleats to be an essential boat accessory, newer designs have tended to recess the cleats into shallow depressions in the gunwales. Some have gone so far as to recess the cleats below the deck or gunwale surface plane and to enclose the recession or pocket with a recession cover. Such pocket dispositions of the cleat, however, severely complicates mechanical attachment of an accessory platform to the cleat.

SUMMARY OF THE INVENTION

The present invention comprises a substantially rigid but preferably buoyant, platform structure having an upper or top surface suitable for securing the desired watercraft fixtures such as, for example, fishing rod holders, flag masts, etc. Projecting substantially normally from the bottom of the platform structure are three to four vertical columns that are length extensible.

Traversing the underside of the platform structure across the approximate midsection is an elongated clamp bar. Proximate of opposite ends of the clamp bar are length adjustable fasteners such as threaded bolts for securing the clamp bar to the platform structure at a desired spatial distance from the bottom of the platform.

A structural ring having a close sliding fit around the perimeter of the clamp bar supports a finger projection from the ring perimeter opposite from the platform. A set screw or cotter pin secures the desired axial position of the ring along the clamp bar length.

The apparatus is secured to the boat deck or gunwale by adjusting the column lengths and clamp bar fasteners to permit penetration of a cleat arc by the anchor finger while the top surface of the platform is level or at the desired angle. With the anchor finger penetrating the arch space of the selected cleat, the adjustable clamp bar fastener proximate of the finger ring is turned to draw the finger up against the cleat cross bar and the support column feet down against the boat deck surface.

BRIEF DESCRIPTION OF THE DRAWINGS

The advantages and further features of the invention will be readily appreciated by those of ordinary skill in the art as the same becomes better understood by reference to the following detailed description when considered in conjunction with the accompanying drawings in which like reference characters designate like or similar elements throughout.

DESCRIPTION OF THE PREFERRED EMBODIMENTS

Figure 1:
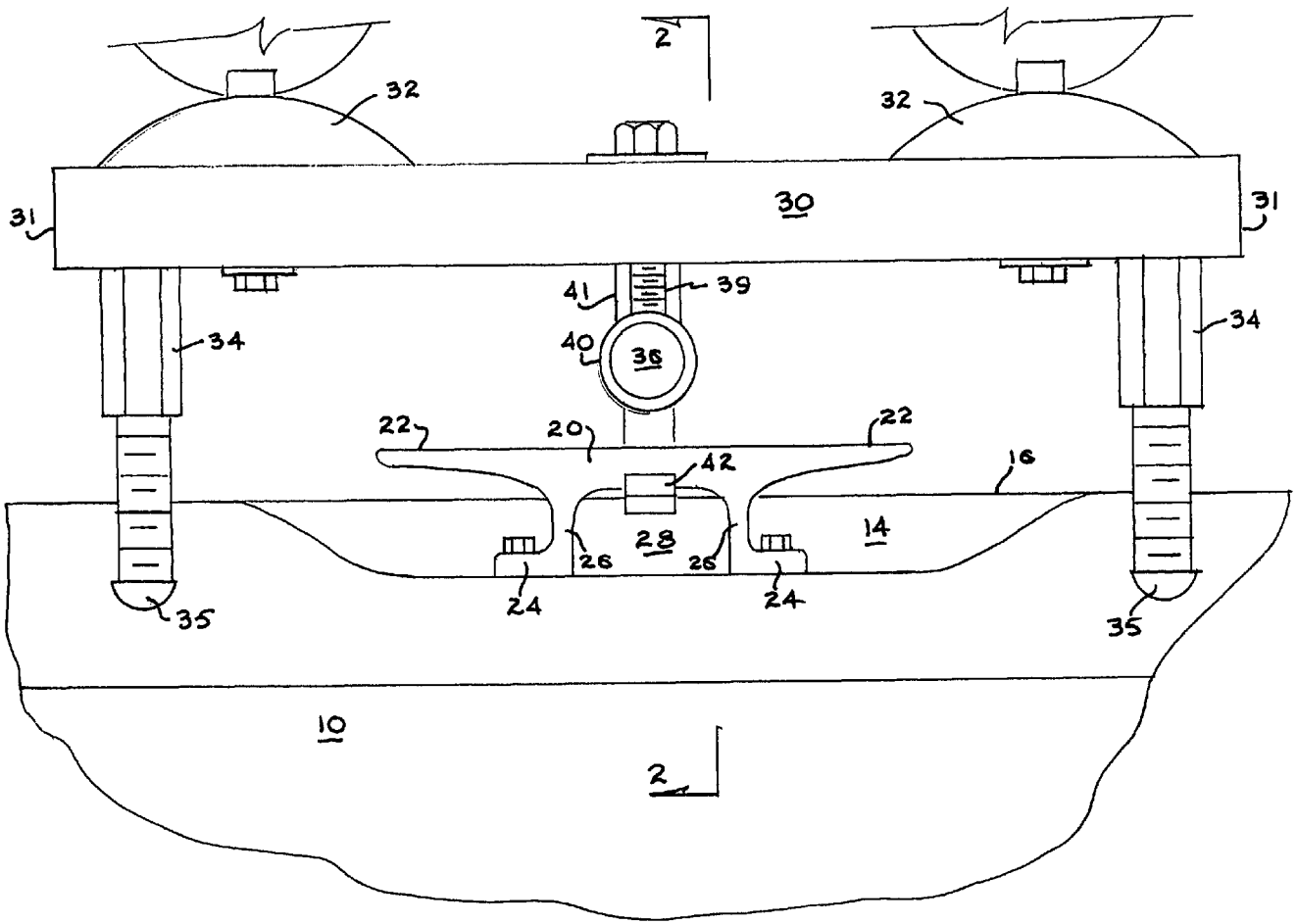
FIG. 1 is a partial elevation of a boat hull at the juncture with the gunwale showing the invention in place.
Figure 2:
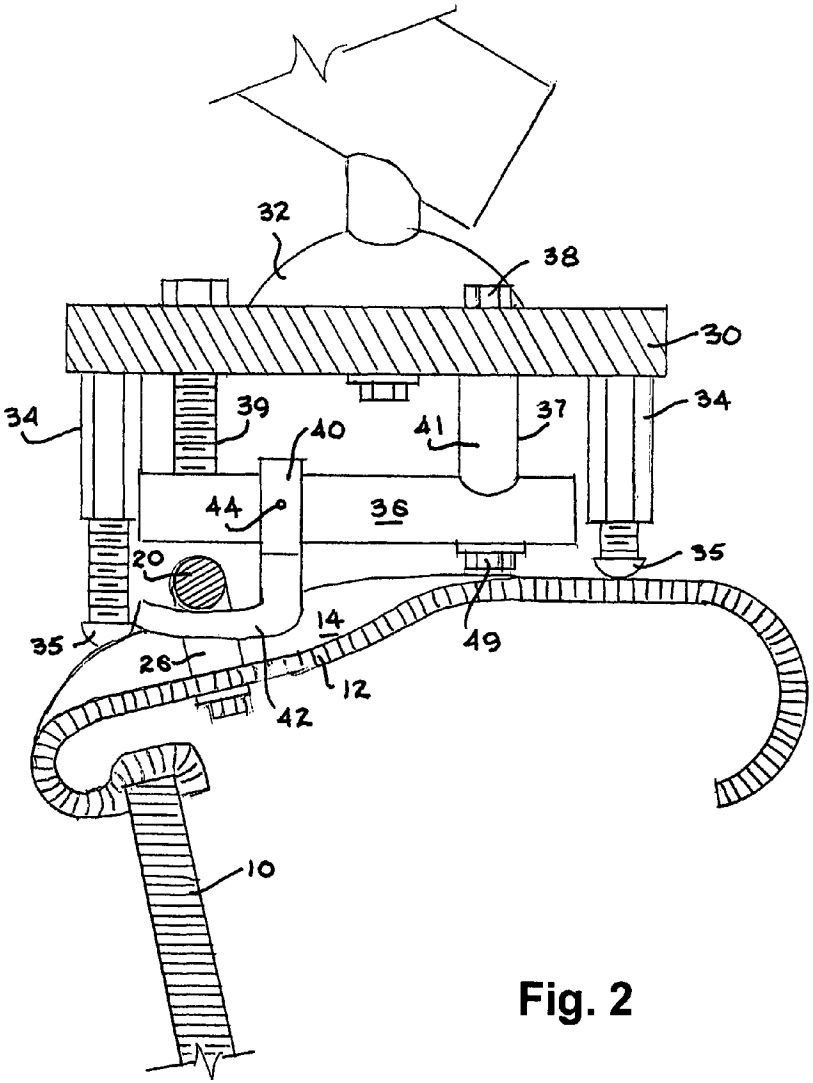
FIG. 2 is a cross-sectional view of a boat hull and the invention as seen along cutting plane 2-2 of FIG. 1.

Drawing FIGS. 1 and 2 illustrate a typical installation for the invention showing a relevant portion of boat hull 10 and gunwale deck 12. A cleat recess or pocket 14 is formed in the surface of the gunwale to at least partially, if not completely, position a boat mooring cleat 20 below the surface continuity of the gunwale deck 16.

A typical mooring cleat 20 comprises a horned bar 22 supported by a pair of legs 26. The cleat is secured to the bottom surface of the gunwale pocket 14 by bolts or screws through respective anchor feet 24. Many contemporary gunwale designs provide an open arch 28 under the horned bar 22 and between the legs 26.

Figure 7:
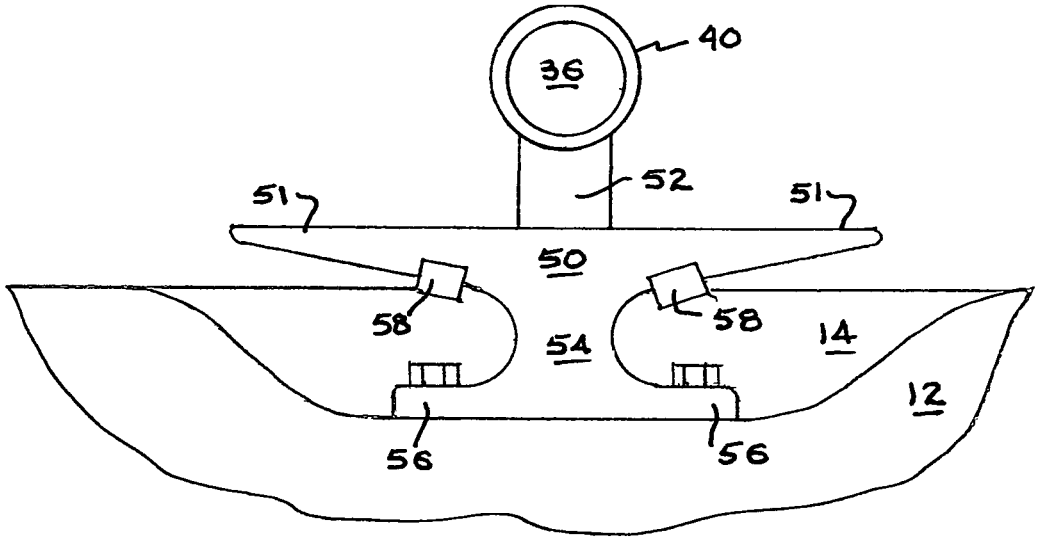
FIG. 7 is a partial elevation of a boat hull at the juncture with the gunwale showing an alternative embodiment of boat cleat and platform anchor.

An alternative cleat embodiment 50, also in common usage, is shown by FIG. 7 to include only one leg 54 secured by a pair of anchor feet 56

One preferred embodiment of the invention includes a substantially planar structural base for an accessory mounting platform 30. Accessory mounts, also characterized herein as appliance holding means, such as one or more rod holders 32 ir flag mast sockets are conveniently secured to the upper or outer surface of the platform. Those of ordinary skill will understand that the platform 30 may take many shapes and forms and may be constructed of diverse materials such as, for example, wood, plastic. or steel. Preferably, the platform 30 is sufficiently buoyant to support all of the holders and attached hardware. Buoyancy may be provided by air chambers, not shown, within the platform 30 or by external float elements.

The platform 30 is supported at a spaced relation above the gunwale deck 16 by structural means such as vertically adjustable support columns 34. The number of columns 34 preferred for a particular application may be variable. Although four columns are preferable, three or even two may sufficient in some cases. It is also preferable that the column distal ends 35 or edges are faced with a soft polymer or elastomer material to prevent scarring or cutting the boat surface finish.

In a transverse plane approximately midway between opposite edges 31 of the platform 30, an axially elongated clamp bar 36 is suspended beneath and substantially parallel with the platform 30 by a pair of vertically adjustable suspension means such as hanger bolts 38 and 39. A threaded tensile means such as a hanger bolt 38 serves as a pivot hanger that permits a limited degree of clamp bar rotation about the junction of the hanger bolt 38 axis and the clamp bar 36 axis. In the preferred embodiment of FIGS. 1 and 2, the bolt 38 is passed freely through a non-threaded aperture in the platform 30, a non-threaded spacer sleeve 41 and a non-threaded aperture 46 in the clamp bar 36. A threaded retainer nut 49 on the end of bolt 38 primarily holds a loose assembly of elements 30, 36, 38 and 41 together during the platform installation procedure.

The length of spacer sleeve 41 is variable depending on the specific application. Various boat, deck and cleat configurations require an individualized evaluation of the necessary length. Many plastics serve as suitable construction materials for the spacer sleeve 41.

With continuing reference to FIGS. 1-4, the opposite end of the clamp bar 30 is also secured by a threaded tensile element such as a bolt 39 that freely penetrates a non-threaded aperture in the platform 30. The bolt 39 is turned into a threaded aperture 48 in the clamp bar 36.

Figure 3:
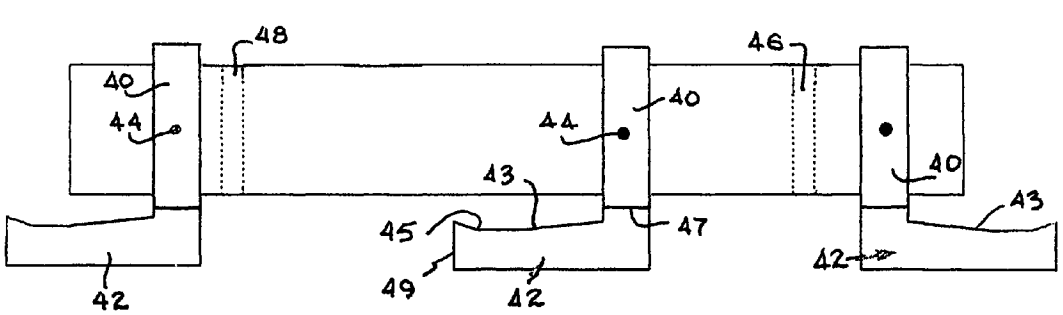
FIG. 3 is a side elevation view of invention clamp bar showing alternative positions of the anchor finger.
Figure 4:
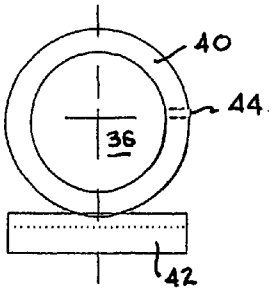
FIG. 4 is an end elevation view of the clamp bar of FIG. 3.

Referring further to FIGS. 3 and 4, the clamp bar 36 supports a carrier means such as a hanger ring 40 having an axially sliding fit over the circumference of the clamp bar. A set screw 44 may be used to secure a desired displacement position of the ring 40 along the axis of the clamp bar. The several locations of ring 40 along the length of clamp bar 36 shown by FIG. 3 are merely representative of the flexibility available for positioning the ring 40 to the geometric configuration of a particular boat.

Secured to the lower perimeter of the hanger ring 40 is a projecting anchor finger 42. Note should be taken of the upper surface profile 43 for the finger 42 which contributes to the continued final security of the article attachment. Specifically, a low point 45 is provided between the finger base 47 and the distal end 49.

To secure the accessory platform to a cleat, the lengths of the several adjustable support columns 34 are adjusted to set the upper surface of the platform 30 at the desired height and angle over the particular mooring cleat 20 to which it is to be attached. This alignment is augmented by the length of the spacing sleeve 41 and the proximity of the anchor finger to the underside of the platform 42. Ultimately, all of these adjustment elements are coordinated to allow the finger end 49 to be inserted into cleat arch 28. With the finger end 49 penetrating the cleat arch 28, the clamping anchor bolt 39 is turned into the threaded bore 48 to raise the finger 42 against the cleat arch bight thereby pressing the column feet 35 tightly against the deck surface. Simultaneously, the clamp bar 36 is drawn tightly against the sleeve 41 to compress the assembly with the underside of the platform 30.

Figure 6:
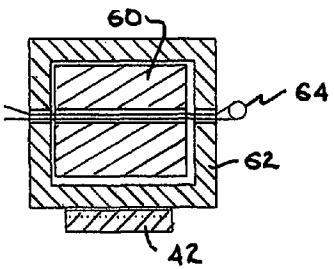
FIG. 6 is a cross section view of the FIG. 5. clamp bar as seen along cutting plane 6-6.
Figure 5:
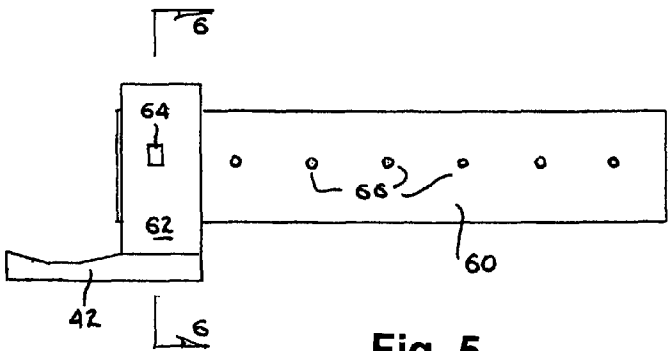
FIG. 5 is a side elevation view of an alternative embodiment for the invention clamp bar and anchor finger.

The clamp bar 36 of FIGS. 1-4 has been shown to be of circular cross-section. Alternatively, the bar may also be given a square or rectangular section as shown by the element 60 of FIGS. 5 and 6. Moreover, by predrilling multiple apertures 66 along the length of the bar, the ring 62 may be secured longitudinally at selected positions by a cotter pin 64.

Figure 8:
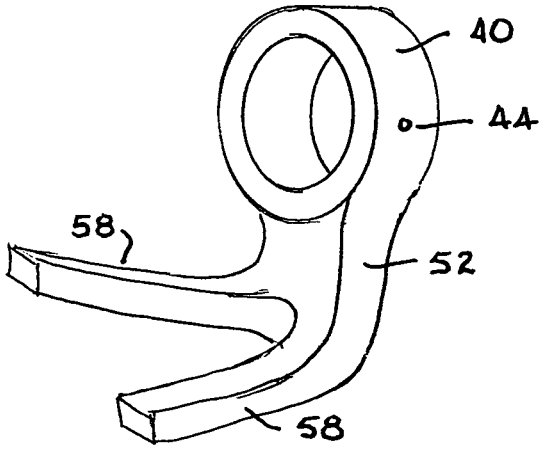
FIG. 8 is a pictorial view of and anchor fork.

FIGS. 7 and 8 illustrate an embodiment of the invention adaptable to a single leg cleat 50. In this embodiment, the clamping finger takes the form of a fork 52 having a pair of tines 58 which straddle the leg 54 and engage the underside of cleat horns 51.

As used herein, the term "boat" is meant to include water buoyant vessels of all types including barges, rafts, boats and ships. The terms "gunwale" and "deck" are used non-exclusively herein as specific examples only of structural support surfaces on a vessel that may have a mooring cleat attached thereto.

Although the invention disclosed herein has been described in terms of specified and presently preferred embodiments which are set forth in detail, it should be understood that this is by illustration only and that the invention is not necessarily limited thereto. Alternative embodiments and operating techniques will become apparent to those of ordinary skill in the art in view of the present disclosure. Accordingly, modifications of the invention are contemplated which may be made without departing from the spirit of the claimed invention.

The invention claimed is:

1. A platform for attaching boating accessories to a mooring cleat comprising:

a. a substantially planar structural base;

b. appliance holding means secured to one face of said base;

c. structural means secured to an opposite face of said base for supporting said base upon a boat deck, said structural means being adjustable to select a height of said base over said deck;

d. axially elongated bar means suspended from said base opposite face between said base and said deck by first and second suspension means, each having an adjustable length to select a respective position for said bar means from said base;

e. carrier means suspended by said bar means for selected displacement along the axial length of said bar means; and, f. finger means secured to said carrier means for engaging a mooring cleat.

2. A platform as described by claim 1 wherein said appliance holding means is a fishing rod holder.

3. A platform as described by claim 1 wherein said second suspension means comprises a threaded tensile element and a compression sleeve.

4. A platform as described by claim 1 wherein said first suspension means comprises a threaded tensile element.

5. A platform as described by claim 1 wherein said carrier means comprises a ring around said elongated bar means.

6. A platform as described by claim 1 wherein said finger means comprises a pair of tines for flanking a mooring cleat leg.

7. A platform as described by claim 1 wherein said finger means comprises a single projection structure for penetrating an arch between a pair of mooring cleat legs.

8. A method of securing an accessory platform to a watercraft surface having a mooring cleat with an arched space between a pair of support legs, said platform having an axially elongated clamping bar secured adjacent to and substantially parallel with an underside surface of said platform by suspension means for selectively moving one end of said clamping bar toward said platform underside surface, a finger projection secured to said clamping bar, said finger projection having an axially translated assembly with said clamping bar; said method comprising the steps of:

axially translating said finger projection along said clamping bar to an appropriate axial position;

securing said finger projection to said clamping bar at said axial position;

inserting sad finger projection into said mooring cleat arched space; and, moving said one end of said clamping bar toward said platform underside surface to engage a bight of said arch by said finger projection.

9. A method of securing an accessory platform to a watercraft surface as described by claim 8 wherein said finger projection is compressively engaged against said arch bight by selective displacement of said clamping bar one end.

10. A boating accessory platform comprising:

a. a substantially planar structural base having a top side and a bottom side;

b. a boating accessory secured to said platform topside;

c. platform support means for supporting said base upon a boat deck, said support means being adjustable to selected a height of said base over said deck;

d. axially elongated bar means suspended from said base bottom side by suspension means having an adjustable length to select a respective position for said bar means displaced from said bottom side;

e. carrier means supported by said bar means for selected displacement along the axial length of said bar means; and, f. finger means secured to said carrier means for engaging a boat mooring cleat.

11. A boating accessory platform as described by claim 10 wherein said boating accessory is a rod holder.

12. A boating accessory platform as described by claim 10 wherein said boating accessory is a flag mast holder.

13. A boating accessory platform as described by claim 10 wherein said suspension means comprises a plurality of selectively elongated columns.

14. A boating accessory platform as described by claim 10 wherein said finger means comprises a single projection for penetrating an arch between a pair of mooring cleat legs.

15. A boating accessory platform as described by claim 10 wherein said finger means comprises a pair of tines for flanking a single leg mooring cleat.

* * * * *